US011891201B2

(12) United States Patent
Yang et al.

(10) Patent No.: US 11,891,201 B2
(45) Date of Patent: Feb. 6, 2024

(54) CABLE BUNDLE TAPING DEVICE

(71) Applicants: Tyco Electronics (Shanghai) Co. Ltd., Shanghai (CN); TE Connectivity Services GmbH, Schaffhausen (CH); Kunshan League Automechanism Co., Ltd., Kunshan (CN)

(72) Inventors: An Yang, Shanghai (CN); Lvhai Hu, Shanghai (CN); Dandan Zhang, Shanghai (CN); Roberto Francisco-Yi Lu, Bellevue, WA (US); Jian Cao, Shanghai (CN); Yun Liu, Shanghai (CN); Yuting He, Kunshan (CN); Haidong Wu, Kunshan (CN); Hui Xiao, Kunshan (CN)

(73) Assignees: Tyco Electronics (Shanghai) Co., Ltd., Shanghai (CN); TE Connectivity Solutions GmbH, Schaffhausen (CH); Kunshan League Automechanism Co., Ltd., Kunshan (CN)

( * ) Notice: Subject to any disclaimer, the term of this patent is extended or adjusted under 35 U.S.C. 154(b) by 531 days.

(21) Appl. No.: 17/069,286

(22) Filed: Oct. 13, 2020

(65) Prior Publication Data

US 2021/0122510 A1 Apr. 29, 2021

(30) Foreign Application Priority Data

Oct. 25, 2019 (CN) ..... 201911028642.1

(51) Int. Cl.
*B65B 27/06* (2006.01)

(52) U.S. Cl.
CPC ..... *B65B 27/06* (2013.01)

(58) Field of Classification Search
CPC ..... B65B 27/06
See application file for complete search history.

(56) References Cited

U.S. PATENT DOCUMENTS 4,502,905 A * 3/1985 Jung ..... B65B 13/327 140/57
8,334,045 B2 * 12/2012 Schaety ..... H01B 13/085 428/167
9,786,416 B1 * 10/2017 Kerstetter ..... H02G 3/32
2017/0278598 A1 * 9/2017 Kerstetter ..... B65B 27/105

* cited by examiner

*Primary Examiner* — Chelsea E Stinson
(74) *Attorney, Agent, or Firm* — Barley Snyder

(57) ABSTRACT

A cable bundle taping device adapted to wind a tape on a coiled cable bundle includes a support frame, a conveying device mounted on the support frame and adapted to convey the tape to a standby position, a first driving wheel rotatably mounted on the support frame and having a slot extending radially inward from an outer edge of the first driving wheel, and a tape binding mechanism arranged on a side of at least one sidewall of the first driving wheel near a bottom of the slot and opposite to the tape in the standby position. The coiled cable bundle is bonded to an end of the tape at the standby position and pushed to the bottom of the slot. The tape is wound on the coiled cable bundle by rotating the tape binding mechanism under driving of the first driving wheel.

25 Claims, 12 Drawing Sheets

CABLE BUNDLE TAPING DEVICE

CROSS-REFERENCE TO RELATED APPLICATION

This application claims the benefit of the filing date under 35 U.S.C. § 119(a)-(d) of Chinese Patent Application No. 201911028642.1, filed on Oct. 25, 2019.

FIELD OF THE INVENTION

The present invention relates to a cable bundle taping device and, more particularly, to a cable bundle taping device adapted to wind a tape on a coiled cable bundle.

BACKGROUND

In order to facilitate storage, transportation and management, a cable bundle such as an electrical cable bundle, a rope cable bundle, or an optical cable bundle is usually rolled into a coil, and then the coiled cable bundle is bound together with a tape. When in use, the tape is removed from the cable bundle to allow uncoiling the cable bundle.

In the related art, the operation of binding the tape to the coiled cable bundle is generally completed manually, which is time-consuming and laborious, reduces the work efficiency, and increases the operation cost.

SUMMARY

A cable bundle taping device adapted to wind a tape on a coiled cable bundle includes a support frame, a conveying device mounted on the support frame and adapted to convey the tape to a standby position, a first driving wheel rotatably mounted on the support frame and having a slot extending radially inward from an outer edge of the first driving wheel, and a tape binding mechanism arranged on a side of at least one sidewall of the first driving wheel near a bottom of the slot and opposite to the tape in the standby position. The coiled cable bundle is bonded to an end of the tape at the standby position and pushed to the bottom of the slot. The tape is wound on the coiled cable bundle by rotating the tape binding mechanism under driving of the first driving wheel.

BRIEF DESCRIPTION OF THE DRAWINGS

The invention will now be described by way of example with reference to the accompanying Figures, of which.

DETAILED DESCRIPTION OF THE EMBODIMENTS

Figure 1:
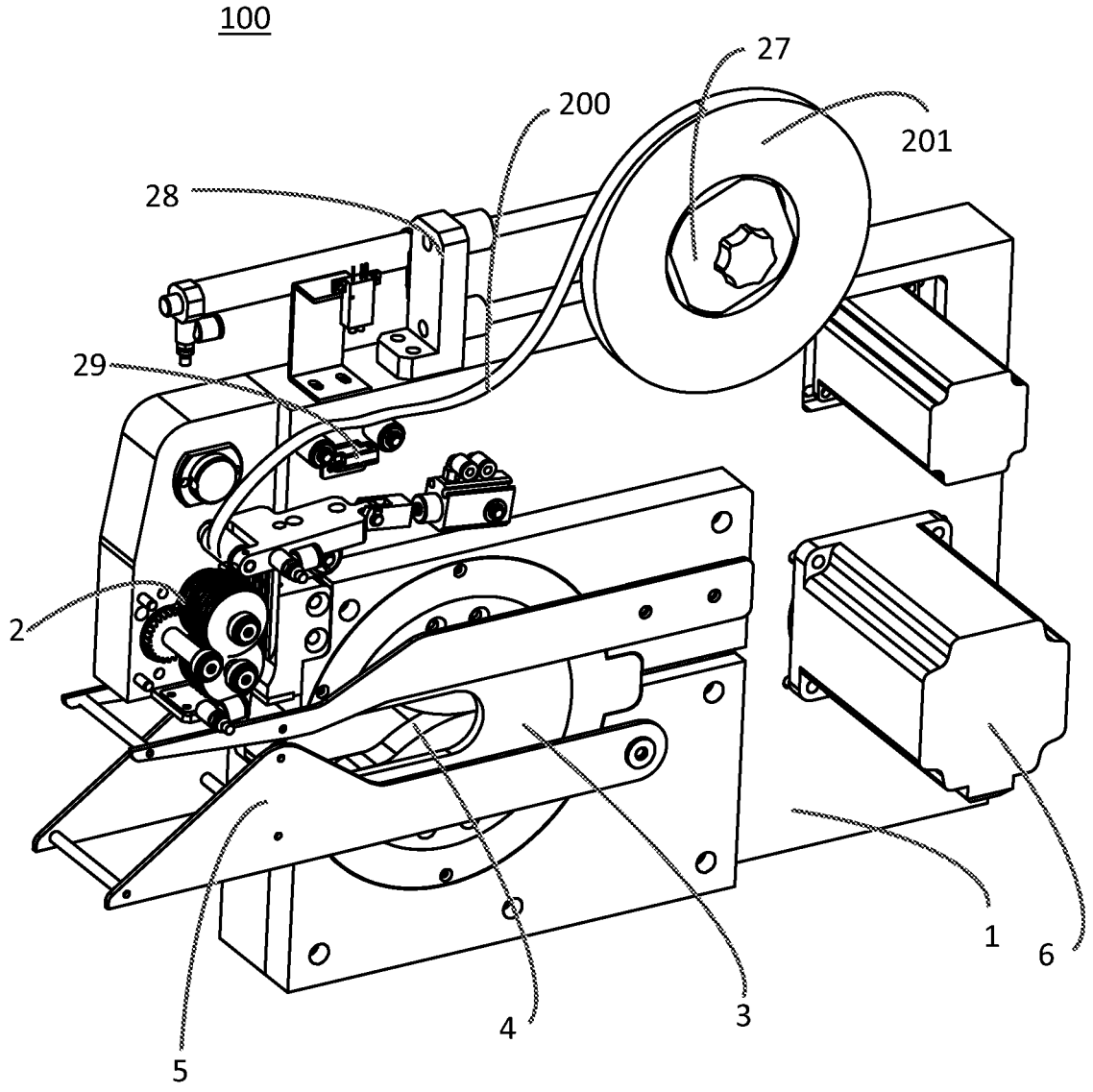
FIG. 1 is a perspective view of a cable bundle taping device according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
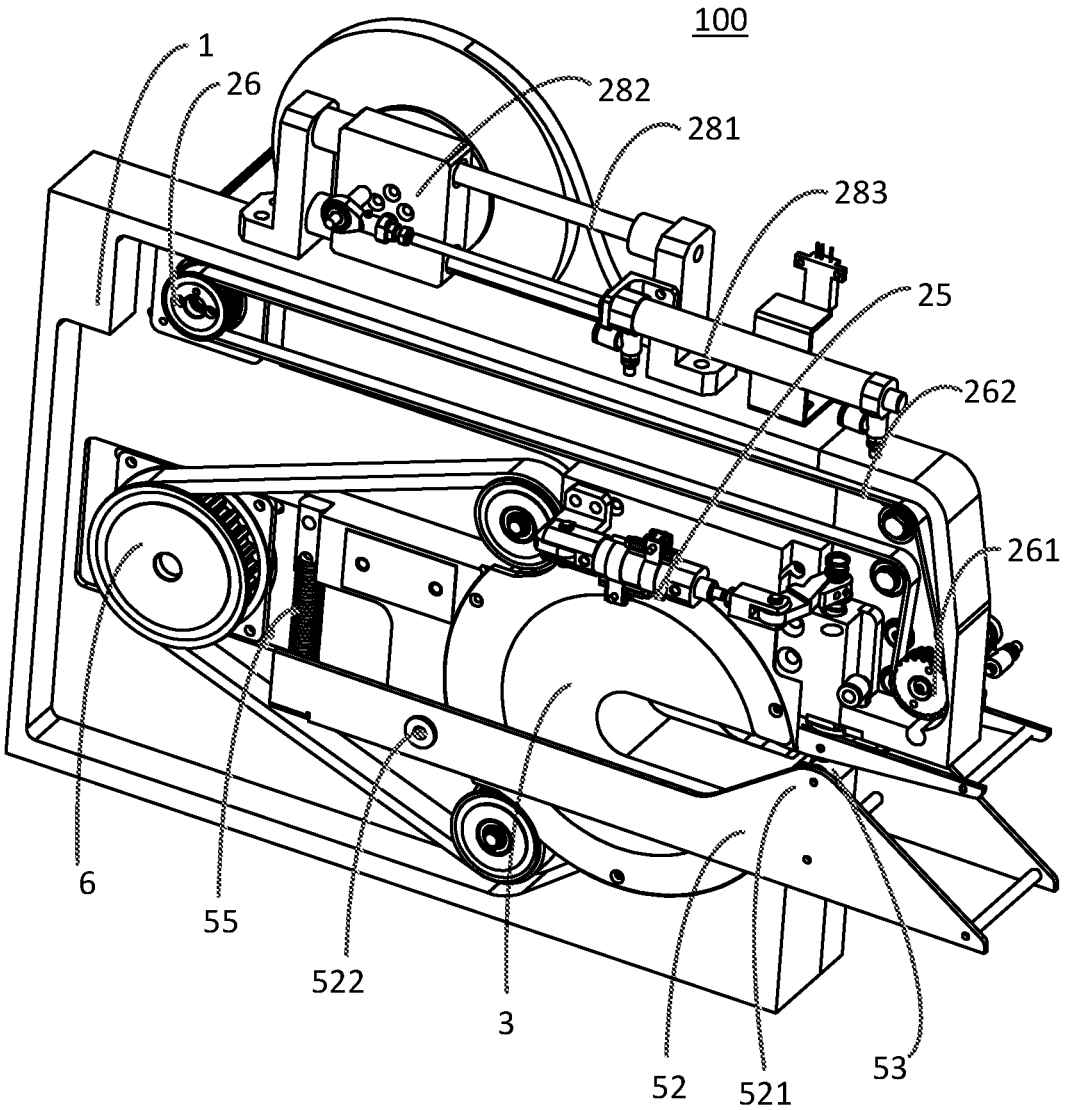
FIG. 2 is another perspective view of the cable bundle taping device.
Figure 3:
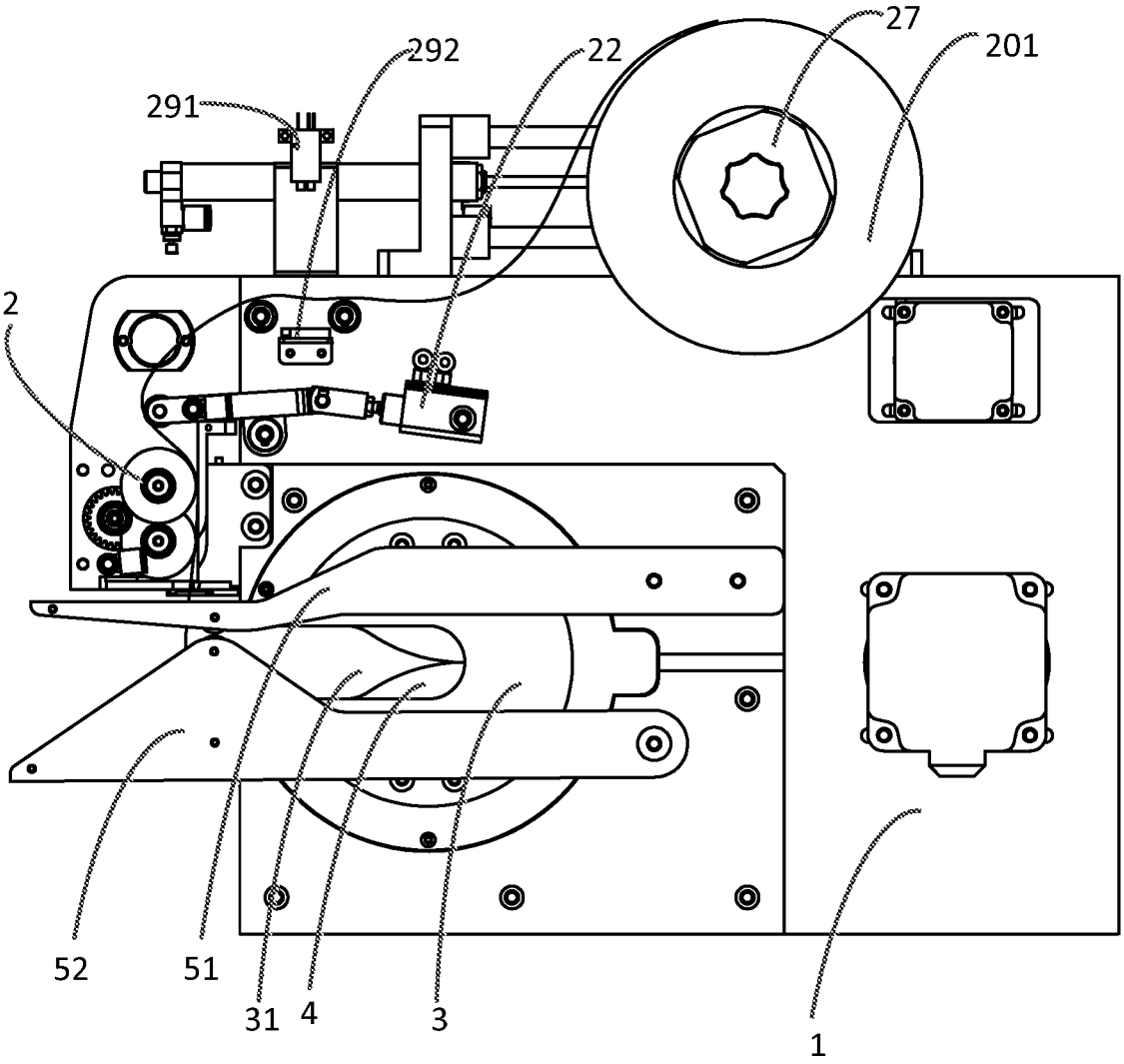
FIG. 3 is a side view of the cable bundle taping device.

A cable bundle taping device 100 according to an embodiment, as shown in FIGS. 1-3, is adapted to wind a tape, for example an adhesive tape, on a coiled cable bundle 300, such as an electrical cable bundle, a rope bundle, an optical cable bundle, etc., so as to facilitate the storage, transportation, and management of the coiled cable bundle 300. The cable bundle taping device 100 comprises a support frame 1, a conveying device 2, a first driving wheel 3, and a tape binding mechanism 4.

In an embodiment, the support frame 1 is vertically installed. The conveying device 2 is mounted on the support frame 1 and adapted to convey the adhesive tape 200 to a standby position R, shown in FIG. 10. As shown in FIGS. 1-3, the first driving wheel 3 is rotatably mounted on the support frame 1 and provided with a slot 31 extending radially inward from an outer edge of the first driving wheel 3. The tape binding mechanism 4 is arranged on a side of at least one sidewall of the first driving wheel 3 near the bottom of the slot 31 and opposite to the tape 200 in the standby position R. In an alternative embodiment, the tape binding mechanism 4 may be arranged between two opposite sidewalls of the first drive wheel 3.

The coiled cable bundle 300 is bonded to one end of the tape 200 at the standby position R. The tape 200 is pushed to the bottom of the slot 31 together with the cable bundle 300, so that the tape 200 is wound on the cable bundle 300 by rotating the tape binding mechanism 4 under the drive of the first driving wheel 3. In this way, the coiled cable bundle 300 is bound by the tape 200. In an embodiment, the coiled cable bundle 300 may be pushed into the slot 31 by a cable bundle conveyor. Before the cable bundle 300 is pushed into the slot 31, one end of the tape 200 in the standby position R is bonded to the coiled cable bundle 300 due to a pushing force of the cable bundle conveyor.

Figure 4:
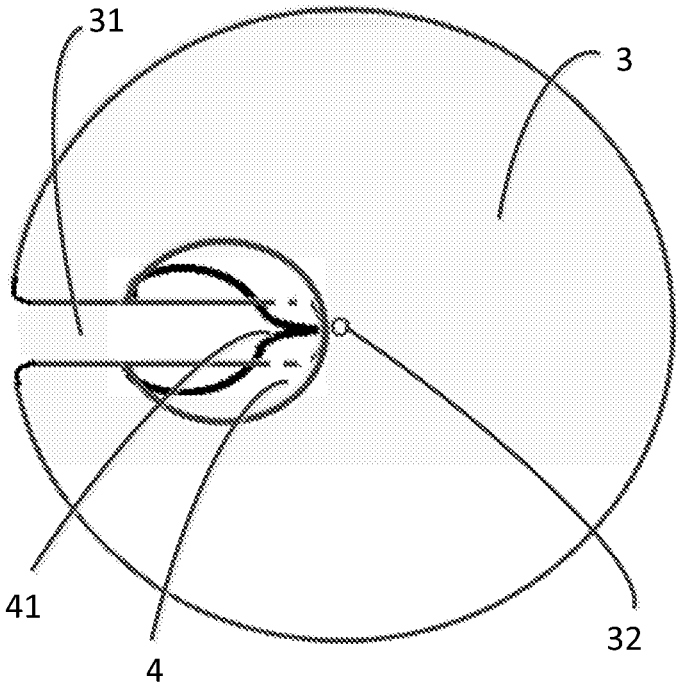
FIG. 4 is a schematic diagram of a first driving wheel and a tape binding mechanism of the cable bundle taping device.
Figure 4A:
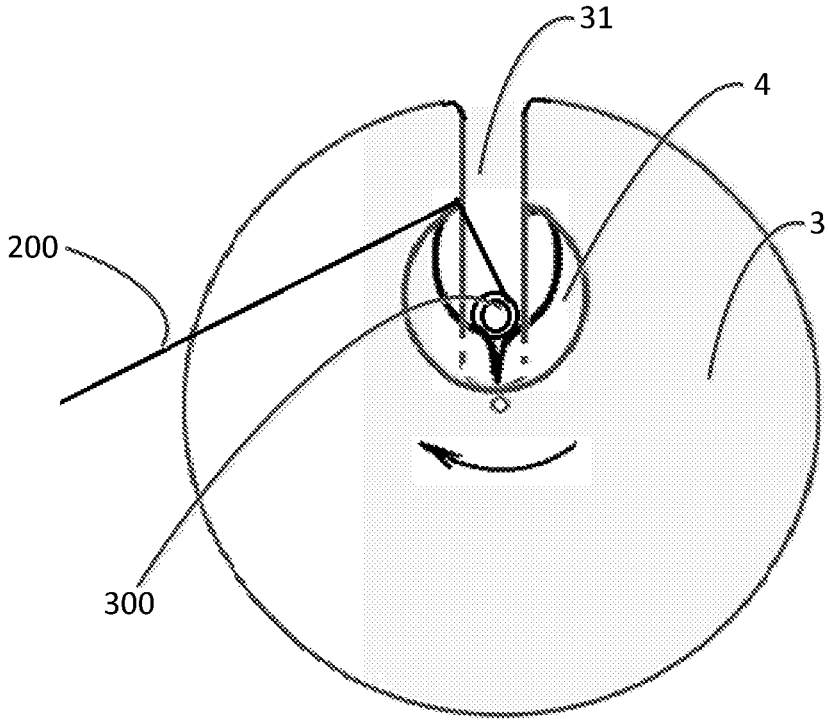
FIG. 4A is a schematic diagram of the first driving wheel and the tape binding mechanism winding a tape.
Figure 5:
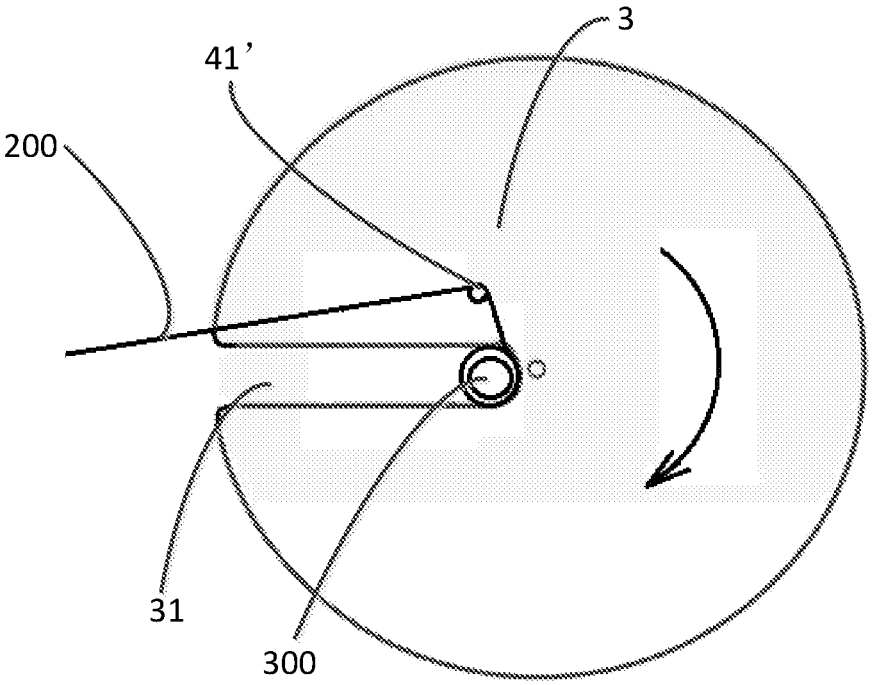
FIG. 5 is a schematic diagram of the first driving wheel and the tape binding mechanism according to another embodiment.
Figure 6:
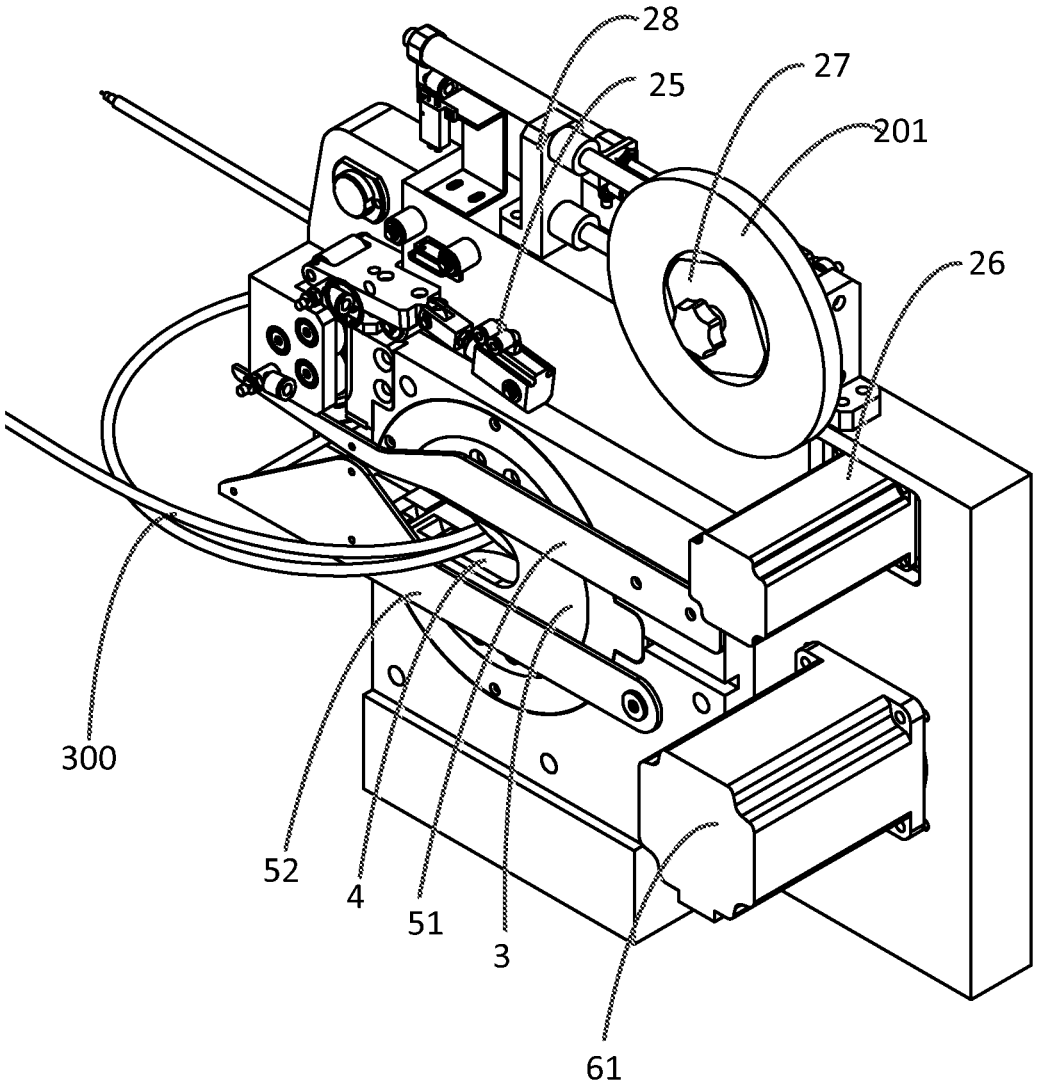
FIG. 6 is a perspective view of the cable bundle taping device with a cable bundle bound to a tape.

As shown in FIGS. 4 and 4A, in an embodiment, the tape binding mechanism 4 has a receiving part 41 adapted to receive a section of the cable bundle 300. The receiving part 41 is at least partially overlapped with the slot 31 in an axial direction. During the operation process, the cable bundle conveyor pushes the coiled cable bundle 300 into the slot 31, while the cable bundle 300 bonded with the tape 200 is partially received in the receiving part 41. The tape binding mechanism 4 is rotated by rotating the first driving wheel 3, while the cable bundle 300 is not rotated. Because the tape binding mechanism 4 protruding from the side of the first driving wheel 3 is aligned with the tape 200 radially extending from the outside to the inside and bonded to the cable bundle 300 received in the receiving part 41, the tape binding mechanism 4 will drive the tape 200 to wind on the cable bundle 300. In this way, the coiled cable bundle 300 is bound by the tape 200.

In an embodiment, the tape binding mechanism 4 has a roughly circular external contour, and the receiving part 41 is formed as an inward concave groove. In this way, the roughly circular external contour of the tape binding mechanism 4 is convenient for the tape 200 to slide on the outer side of the tape binding mechanism 4, and the inward concave groove is convenient for positioning the cable bundle 300.

As shown in FIGS. 1-3 and 5, in an embodiment, the tape binding mechanism 4 includes a blocking part 41' axially extending from the first driving wheel 3. The blocking part 41' is aligned with the tape 200 radially extending from the outside to the inside and bonded to the cable bundle 300. When the first driving wheel 3 is rotated, the blocking part 41' will drive the tape 200 to wind around the cable bundle 300, to bind the coiled cable bundle 300. In an embodiment, a first roller, which is rotatable relative to the first driving wheel 3, is provided on the blocking part 41', so as to facilitate the tape 200 to slide on the first roller and drive the first roller to rotate at the same time.

In an embodiment, as shown in FIGS. 1-3 and 6-7, the cable bundle taping device 100 further comprises a shutter device 5. The shutter device 5 is mounted on the support frame 1 near the standby position R. The shutter device 5 is configured to be opened under the driving of the cable bundle 300 to allow the cable bundle 300 to enter into or move out of the slot 31. While the cable bundle 300 opens the shutter device 5 and enters into the slot 31, one end of the tape 200 is bonded to the cable bundle 300 and moved to a winding position (for example, the receiving part 41) with the cable bundle 300.

In an embodiment, as shown in FIGS. 1-3, the shutter device 5 comprises a fixing frame 51 fixed on the support frame 1; and a movable frame 52 mounted on the support frame 1 in a movable way relative to the fixing frame 51 under the driving of the cable bundle 300. In an embodiment, the movable frame 52 comprises two movable arms which are respectively pivotally mounted on both sides of the support frame 1 by a pivot 522. A guide part 521 with a substantially triangle shape is provided on each of the two movable arms. The shutter device 5 further comprises a second roller 53 which is rotatably mounted between the two movable arms and is located at a top of the guide part 521. In this way, the cable bundle 300 may slide to the second roller 53 under the guidance of the guide part 521, and push the movable frame 52 to rotate away from the fixing frame 51, so as to allow the cable bundle 300 to enter into or move out of the slot 31 of the first driving wheel 3.

Figure 10:
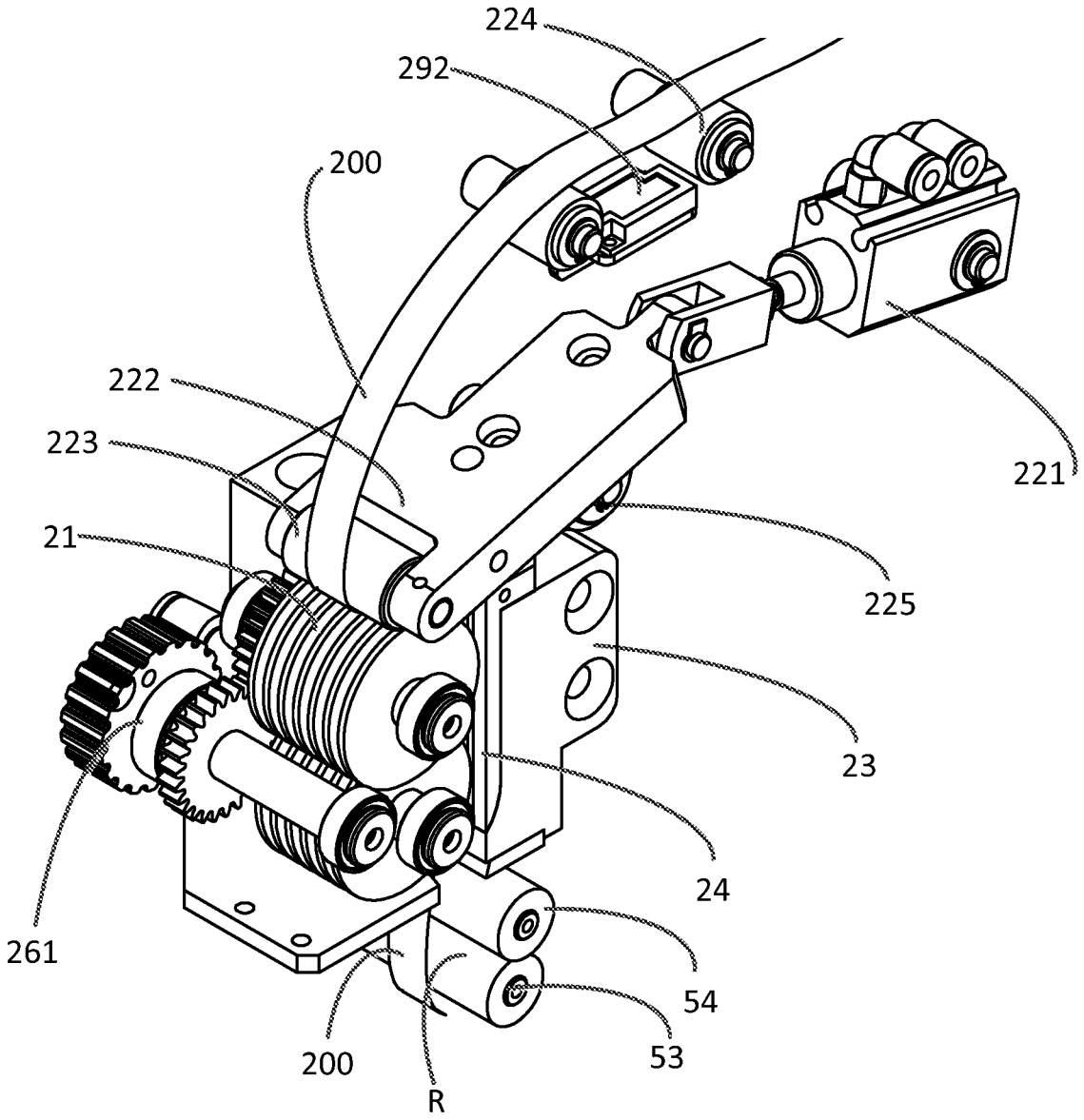
FIG. 10 is an enlarged view of a portion A of the conveying device in FIG. 8.

In an embodiment, as shown in FIGS. 1-3, 6-7 and 10, the fixing frame 51 comprises two fixing arms which are respectively mounted on both sides of the support frame 1. The shutter device 5 further comprises a third roller 54 which is rotatably mounted between the two fixing arms and faces the second roller 53. With respect to the slot 31, the standby position R is located outside the second roller 53 and the third roller 54, as shown in FIG. 10.

In an embodiment, the shutter device 5 further comprises a return spring 55. The return spring 55 has a first end, an upper end shown in FIGS. 2 and 7, connected to the support frame 1 and a second end, a lower end shown in FIGS. 2 and 7, connected to the movable frame 52, so that the movable frame 52 moves away from the fixing frame 51 against the spring force of the return spring 55. In this way, the coiled cable bundle 300 is driven by the cable bundle conveyor to abut against the outside of the second roller 53 and the third roller 54, so that one end of the tape 200 is bonded to the cable bundle 300. Then the coiled cable bundle 300 further pushes the movable frame 52 to open the shutter device 5 against the spring force of the return spring 55, and pushes the cable bundle 300 into the slot 31.

In an embodiment, the cable bundle taping device 100 further comprises a first driving device 6, shown in FIGS. 1, 2, 6, and 7. The first driving device 6 is configured to drive the first driving wheel 3 to rotate. In an embodiment, the first driving device 6 comprises a first motor 61 mounted on the support frame 1, and a first driving belt 62. The first driving wheel 3 is arranged between the standby position R and the first motor 61. The first driving belt 62 is constructed to bring into contact with a portion of the first driving wheel 3 opposite to the standby position R and drive the first driving wheel 3 to rotate under the driving of the first motor 61. With this arrangement, it will not obstruct the operation of pushing the cable bundle 300 into the slot 31.

In an alternative embodiment, the first driving device 6 may include a motor directly axially coupled to the first driving wheel 3. In other words, a driving shaft of the motor is directly coupled with a rotating shaft 32 of the first driving wheel 3, thereby driving the first driving wheel 3 to rotate.

Figure 7:
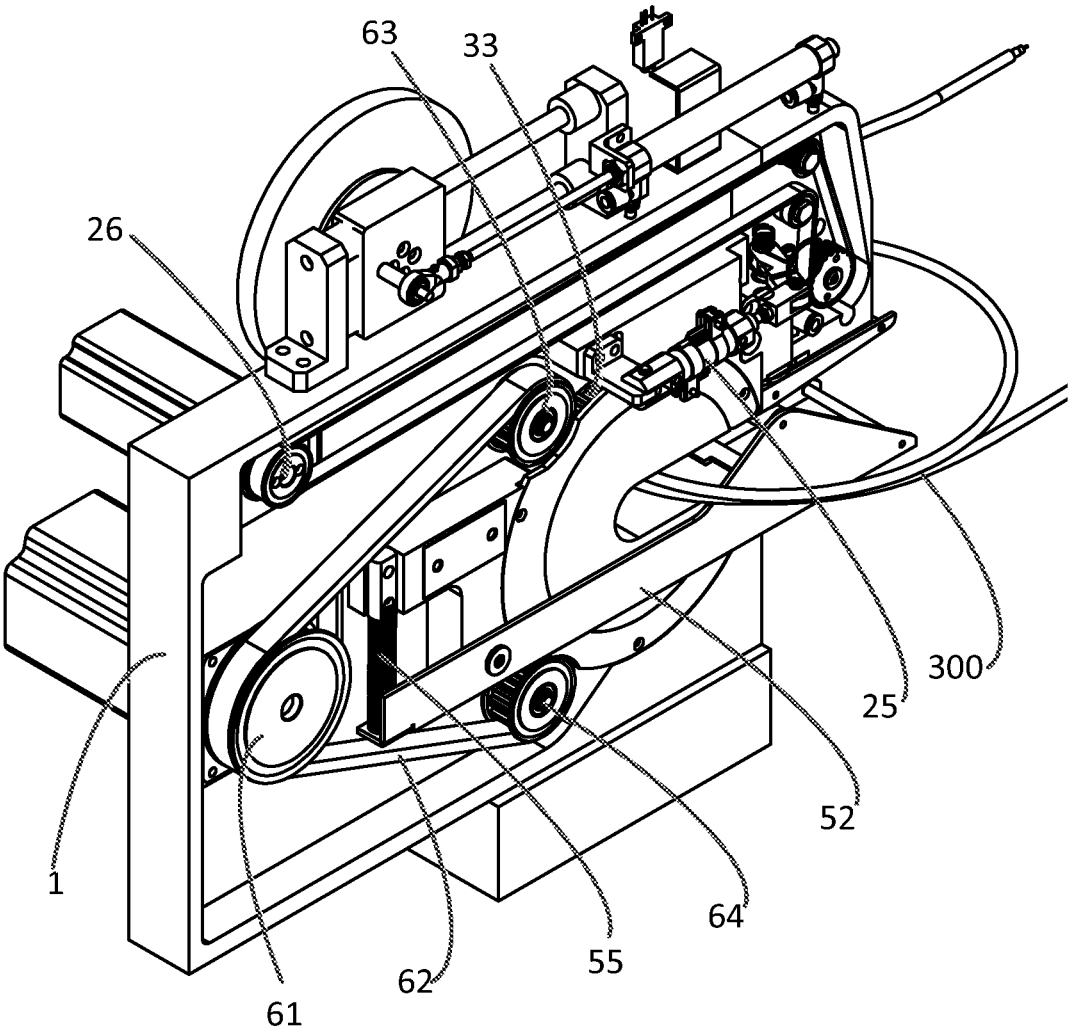
FIG. 7 is another perspective view of the cable bundle taping device with the cable bundle bound to the tape.

In an embodiment, as shown in FIG. 7, the first driving device 6 further comprises a fourth roller 63 and a fifth roller 64 which are respectively mounted on the support frame 1, and form a triangle arrangement with the first motor 61, so that the first driving belt 62 surrounded on the first motor 61, the fourth roller 63, and the fifth roller 64 is engaged with the portion of the first driving wheel 3 opposite to the standby position R and drives the first driving wheel 3 to rotate. In an embodiment, the first driving belt 62 is meshed with the first motor 61 and the first driving wheel 3, respectively, in the way of rack contact. In other words, a plurality of racks are arranged on the outer edge 33 of the first drive wheel 3 and the first drive belt 62, so as to prevent the first drive belt 62 from sliding relative to the first motor 61 and the first drive wheel 3.

In an embodiment, as shown in FIGS. 1-3 and 6-10, the conveying device 2 comprises a second driving wheel 21, a pressing mechanism 22, and a base 23. The second driving wheel 21 is rotatably mounted on the support frame 1. The pressing mechanism 22 is configured to press the tape 200 onto the second driving wheel 21 to drive the tape 200 to move. The base 23 is mounted on the support frame 1. The tape 200 passing through the pressing mechanism 22 is limited between the second driving wheel 21 and the base 23 to convey the tape 200 to the standby position R.

In an embodiment, the pressing mechanism 22 comprises a first pushing mechanism 221, a first lever 222, and a sixth roller 223. The first lever 222 is pivotally mounted on the support frame 1 by a pivot 225, and a first end, a right end shown in FIG. 10, of the first lever 222 is engaged with the first pushing mechanism 221. The sixth roller 223 is rotatably mounted on a second end, a left end shown in FIG. 10, of the first lever 222, so that the sixth roller 223 is cooperated with the second driving wheel 21 to clamp the tape 200 and drive the tape 200 to move under the drive of the first pushing mechanism 221. It is appreciated that in the case where the second end of the first lever 222 is smooth, the sixth roller 223 may be omitted. In an embodiment, the first pushing mechanism 221 may include a pneumatic cylinder, a hydraulic cylinder or an electric telescopic mechanism. The movement of the piston rod of the pneumatic cylinder or the hydraulic cylinder drives the first lever 222 to rotate around the pivot 225, so that the sixth roller 223 is close to or far away from the second driving wheel 21, and clamps or releases the tape 200 between the sixth roller 223 and the second driving wheel 21.

Figure 8:
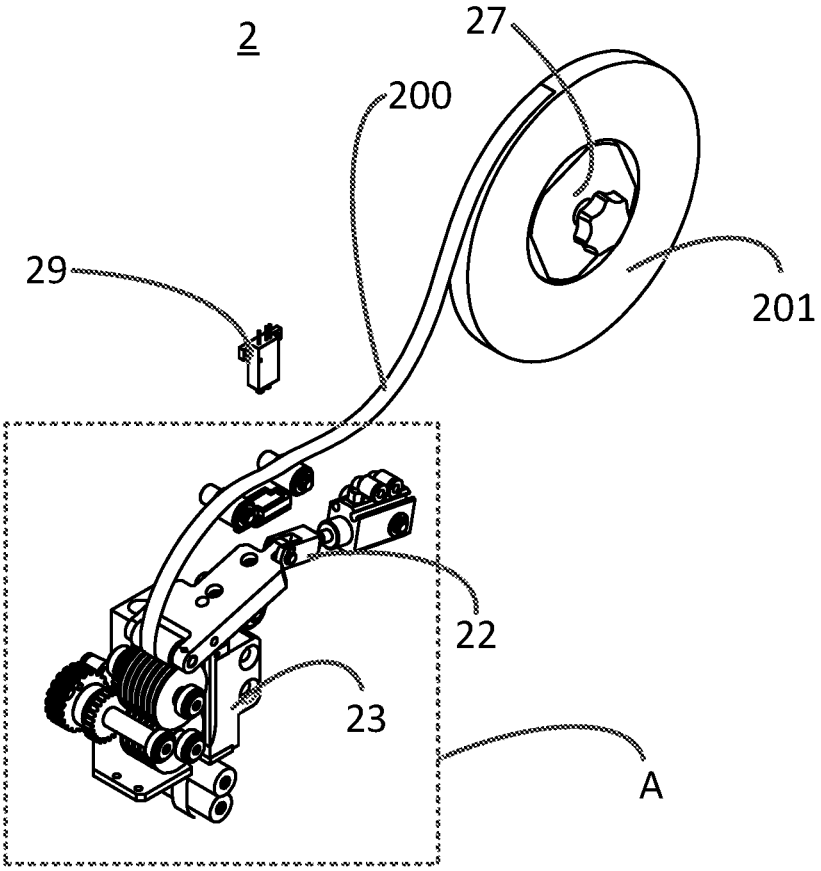
FIG. 8 is a perspective view of a conveying device of the cable bundle taping device.
Figure 9:
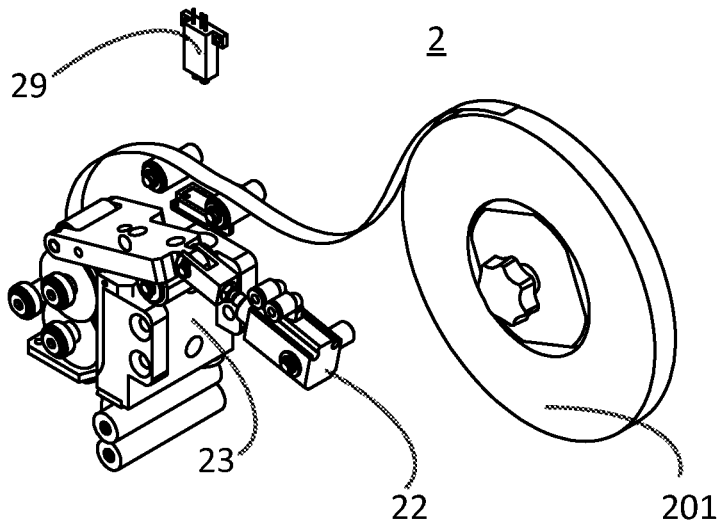
FIG. 9 is another perspective view of the conveying device.

In an embodiment, as shown in FIGS. 8-10, the conveying device 2 further comprises a guide mechanism 24 which is detachably mounted on the base 23 and is configured to guide the adhesive tape 200 to the standby position R. On the one hand, the guide mechanism 24 is constructed to guide the moving path of the tape 200; on the other hand, before the tape 200 moves between the second driving wheel 21 and the base 23, the guide mechanism 24 may be removed to increase the gap between the base 23 and the second roller 21 so that the tape 200 may smoothly pass through between the second driving wheel 21 and the base 23, and after the tape 200 passes through between the second driving wheel 21 and the base 23, the guide mechanism 24 is mounted in position to reduce the gap between the base 23 and the second roller 21, thereby reliably guiding the tape 200 to move. In an embodiment, two second driving wheels 21 may be provided.

In an embodiment, as shown in FIGS. 1-3 and 6-10, the conveying device 2 further comprises a second motor 26 mounted on the support frame 1, and a transmission mechanism adapted to transmit the rotation of the second motor 26 to two second driving wheels 21. In an embodiment, the transmission mechanism comprises a transfer wheel 261 engaged with two second driving wheels 21, and a second driving belt 262 engaged with the transfer wheel 261 and the second motor 26, so that the second motor 26 drives the transfer wheel 261 to rotate through the second driving belt 262, and the transfer wheel 261 drives the second driving wheels 21 to rotate. In this arrangement, the transfer wheel 261 is meshed with the second driving belt 262 and the second driving wheel 21 respectively, which may play the role of a reducer. In an exemplary embodiment, the first motor 61 and the second motor 26 may include a DC servo motor.

In an alternative embodiment, the second driving wheel 21 may be directly driven by a motor. In other words, the drive shaft of the motor is directly coupled with the shaft of the second driving wheel 21, thereby driving the second driving wheel 21 to rotate.

In an embodiment, as shown in FIGS. 1, 3, and 8, the conveying device 2 further comprises a seventh roller 27 rotationally mounted on the support frame 1. A reel 201 adapted to wind the tape 200 is mounted on the seventh roller 2. The tape 200 unwound from the reel 201 is transported between the pressing mechanism 22 and the second driving wheel 21. The conveying device 2 further comprises a sensor 29 adapted to detect whether there is the tape 200 unwound from the reel 201. If no tape is detected, the whole cable bundle taping device 100 is stopped. For example, the sensor 29 includes a light emitter 291 and a light receiver 292. It may determine whether there is the tape 200 on the movement path of the tape based on the intensity of light received by the light receiver 292.

In an embodiment, as shown in FIGS. 1-3, 6-7 and 11, the conveying device 2 further comprises a cutting mechanism 25 adapted to cut off the tape 200 passing through the base 23, so that the tape binding mechanism 4 may wind the cut tape 200 onto the cable bundle 300. In an embodiment, the cutting mechanism 25 comprises a driving shaft 251 rotatably mounted on the base 23, a cutter 252 mounted at a lower end of the driving shaft 251, and a first driving mechanism mounted on an upper end of the driving shaft 251 and configured to drive the driving shaft 251 to rotate relative to the base 23, so as to drive the cutter 252 to cut off the tape 200.

Figure 11:
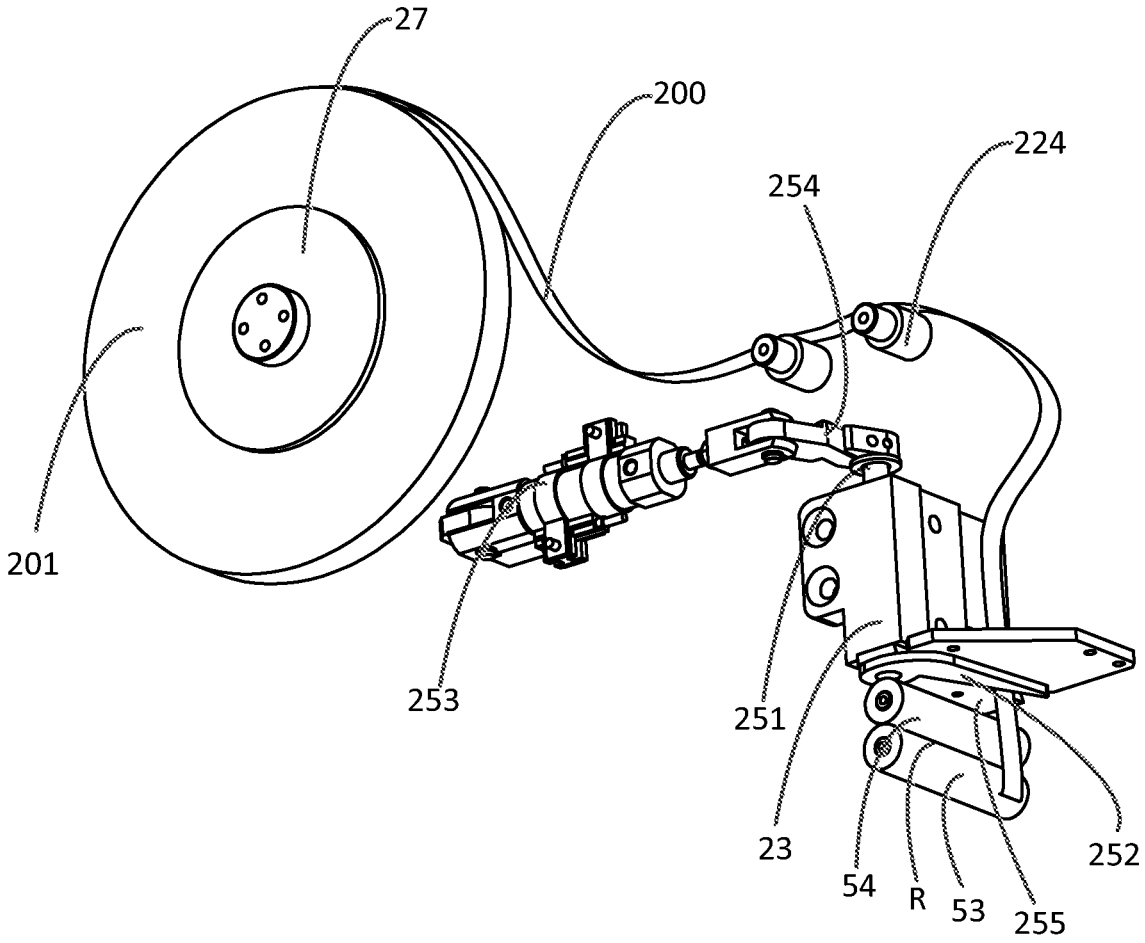
FIG. 11 is a perspective view of a cutting mechanism of the cable bundle taping device.

In an embodiment, as shown in FIG. 11, the first driving mechanism comprises a second pushing mechanism 253 mounted on the support frame 1 and a second lever 254 having a first end pivotally engaged with the second pushing mechanism 253. A second end of the second lever 254 is connected to an upper end of the driving shaft 251, so that the second pushing mechanism 253 is adapted to push the driving shaft 251 to rotate by the second lever 254. In an embodiment, the second pushing mechanism 253 may include a pneumatic cylinder, a hydraulic cylinder or an electric telescopic mechanism. The movement of the piston rod of the pneumatic cylinder or the hydraulic cylinder drives the second lever 254 to rotate around the pivot, so as to drive the cutter 252 mounted at the lower end of the driving shaft 251 to cut off the tape 200.

In an embodiment, the cutting mechanism 25 further comprises a fixed cutter 255 mounted at the lower part of the base 23, as shown in FIG. 11. The fixed cutter 255 and the cutter 252 are formed as a scissors structure and cooperated with each other to cut off the tape 200.

It should be noted that, for the convenience of description, the standby position R near the second roller 53 and the third roller 54 shown in FIG. 11 is adjacent to the cutter 252, but it is appreciated by those skilled in the art that there is a predetermined distance between the standby position R and the cutter 252, so that the cut-off tape has an enough length to be wound on the cable bundle 300.

In an embodiment, as shown in FIGS. 1-3 and 6-7, the conveying device 2 further comprises a stretching mechanism 28 mounted on the support frame 1. The seventh roller 27 is movably mounted on the stretching mechanism 28 to straighten the tape 200 unwound from the reel 201. In an embodiment, the stretching mechanism 28 comprises a guide rail 281, a slide block 282, and a second driving mechanism 283. The guide rail 281 is mounted on the support frame 1. The slide block 282 is slidably mounted on the guide rail 281. The seventh roller 27 is mounted on the slide block 282. The second driving mechanism 283 is adapted to drive the slide block 282 to move, so as to stretch the tape 200 unwound from the reel 201 from a relaxation state to a straightening state. In an embodiment, the second driving mechanism 283 may include a pneumatic cylinder, a hydraulic cylinder or an electric telescopic mechanism, wherein the movement of the piston rod of the pneumatic cylinder or the hydraulic cylinder drives the slide block 282 to move on the guide rail 281, thereby driving the reel 201 to move.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle. Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A cable bundle taping device adapted to wind a tape on a coiled cable bundle, comprising:

a support frame;

a conveying device mounted on the support frame and adapted to convey the tape to a standby position;

a first driving wheel rotatably mounted on the support frame and having a slot extending radially inward from an outer edge of the first driving wheel;

a shutter device mounted on the support frame near the standby position, the shutter device is opened by the coiled cable bundle to allow the coiled cable bundle to enter into or move out of the slot, the end of the tape is bonded to the coiled cable bundle while the coiled cable bundle opens the shutter device and enters into the slot; and a tape binding mechanism arranged on a side of at least one sidewall of the first driving wheel near a bottom of the slot and opposite to the tape in the standby position, the coiled cable bundle is bonded to an end of the tape at the standby position and pushed to the bottom of the slot, the tape is wound on the coiled cable bundle by rotating the tape binding mechanism under driving of the first driving wheel.

2. The cable bundle taping device according to claim 1, wherein the shutter device includes a fixing frame fixed on the support frame and a movable frame mounted on the support frame in a movable way relative to the fixing frame under the driving of the coiled cable bundle.

3. The cable bundle taping device according to claim 2, wherein the movable frame has a pair of movable arms which are pivotally mounted on a pair of sides of the support frame, a guide part with a triangle shape is disposed on each of the movable arms, the shutter device includes a first roller rotatably mounted between the movable arms and located at a top of the guide part.

4. The cable bundle taping device according to claim 3, wherein the fixing frame includes a pair of fixing arms which are mounted on both sides of the support frame, the shutter device has a second roller rotatably mounted between the fixing arms and facing the first roller, the standby position is located outside the first roller and the second roller.

5. The cable bundle taping device according to claim 2, wherein the shutter device includes a return spring having a first end connected to the support frame and a second end connected to the movable frame, the movable frame moves away from the fixing frame against a spring force of the return spring.

6. The cable bundle taping device according to claim 1, further comprising a first driving device configured to drive the first driving wheel to rotate.

7. The cable bundle taping device according to claim 6, wherein the first driving device includes a first motor mounted on the support frame, the first driving wheel arranged between the standby position and the first motor, and a first driving belt brought into contact with a portion of the first driving wheel opposite to the standby position to drive the first driving wheel to rotate under the driving of the first motor.

8. The cable bundle taping device according to claim 7, wherein the first driving device includes a first roller and a second roller mounted on the support frame and formed as a triangle arrangement with the first motor, the first driving belt surrounded on the first motor, the first roller and the second roller are engaged with the portion of the first driving wheel opposite to the standby position to drive the first driving wheel to rotate.

9. The cable bundle taping device according to claim 8, wherein the first driving belt is meshed with the first motor and the first driving wheel in a rack contact.

10. A cable bundle taping device adapted to wind a tape on a coiled cable bundle, comprising: a support frame; a first driving wheel rotatably mounted on the support frame and having a slot extending radially inward from an outer edge of the first driving wheel; a conveying device mounted on the support frame and adapted to convey the tape to a standby position, wherein the conveying device includes: at least one driven second driving wheel rotatably mounted on the support frame; a pressing mechanism configured to press the tape onto the second driving wheel to drive the tape to move; and a base mounted on the support frame, the tape passing through the pressing mechanism is positioned between the second driving wheel and the base to convey the tape to the standby position; and a tape binding mechanism arranged on a side of at least one sidewall of the first driving wheel near a bottom of the slot and opposite to the tape in the standby position, the coiled cable bundle is bonded to an end of the tape at the standby position and pushed to the bottom of the slot, the tape is wound on the coiled cable bundle by rotating the tape binding mechanism under driving of the first driving wheel.

11. The cable bundle taping device according to claim 10, wherein the pressing mechanism includes: a first pushing mechanism; a first lever pivotally mounted on the support frame and having a first end engaged with the first pushing mechanism; and a first roller rotatably mounted on a second end of the first lever, so that the first roller is cooperated with the second driving wheel to clamp the tape under the drive of the first pushing mechanism.

12. The cable bundle taping device according to claim 11, wherein the conveying device includes a guide mechanism detachably mounted on the base and configured to guide the tape to the standby position.

13. The cable bundle taping device according to claim 10, wherein the conveying device includes a cutting mechanism adapted to cut off the tape passing through the base.

14. The cable bundle taping device according to claim 13, wherein the cutting mechanism includes:

a driving shaft rotatably mounted on the base;

a cutter mounted at a lower end of the driving shaft; and a first driving mechanism mounted on an upper end of the driving shaft and configured to drive the driving shaft to rotate relative to the base, so as to drive the cutter to cut off the tape.

15. The cable bundle taping device according to claim 14, wherein the first driving mechanism includes:

a second pushing mechanism mounted on the support frame; and a second lever having a first end pivotally engaged with the second pushing mechanism and a second end connected to an upper end of the driving shaft, the second pushing mechanism pushes the driving shaft to rotate by the second lever.

16. The cable bundle taping device according to claim 14, wherein the cutting mechanism includes a fixed cutter mounted at a lower part of the base and cooperated with the cutter to cut off the tape.

17. The cable bundle taping device according to claim 10, wherein the conveying device includes a second motor mounted on the support frame and a transmission mechanism adapted to transmit the rotation of the second motor to a pair of the second driving wheels.

18. The cable bundle taping device according to claim 17, wherein the transmission mechanism includes a transfer wheel engaged with the second driving wheels and a second driving belt engaged with the transfer wheel and the second motor, the second motor drives the transfer wheel to rotate through the second driving belt.

19. The cable bundle taping device according to claim 10, wherein the conveying device includes a second roller rotationally mounted on the support frame, a reel adapted to wind the tape is mounted on the second roller, the tape unwound from the reel is transported between the pressing mechanism and the second driving wheel.

20. The cable bundle taping device according to claim 19, wherein the conveying device includes a stretching mechanism mounted on the support frame, the second roller is movably mounted on the stretching mechanism to straighten the tape unwound from the reel.

21. The cable bundle taping device according to claim 20, wherein the stretching mechanism includes: a guide rail mounted on the support frame; a slide block slidably mounted on the guide rail, the second roller mounted on the slide block; and a second driving mechanism adapted to drive the slide block to move, so as to stretch the unwound tape from a relaxation state to a straightening state.

22. The cable bundle taping device according to claim 19, wherein the conveying device incudes a sensor adapted to detect whether the tape is unwound from the reel.

23. A cable bundle taping device adapted to wind a tape on a coiled cable bundle, comprising:

a support frame;

a conveying device mounted on the support frame and adapted to convey the tape to a standby position;

a first driving wheel rotatably mounted on the support frame and having a slot extending radially inward from an outer edge of the first driving wheel; and a tape binding mechanism arranged on a side of at least one sidewall of the first driving wheel near a bottom of the slot and opposite to the tape in the standby position, the coiled cable bundle is bonded to an end of the tape at the standby position and pushed to the bottom of the slot, the tape is wound on the coiled cable bundle by rotating the tape binding mechanism under driving of the first driving wheel, the tape binding mechanism includes a receiving part arranged within the slot and adapted to receive a section of the coiled cable bundle, the receiving part defining, with respect to a center of the slot:

a first concave surface proximate an open end of the slot; and a second convex surface proximate a closed end of the slot.

24. The cable bundle taping device according to claim 23, wherein the receiving part is discrete from and extends into the slot, and is at least partially overlapped with the slot in an axial direction.

25. The cable bundle taping device according to claim 24, wherein the tape binding mechanism has a roughly circular external contour, the receiving part is formed as an inward concave groove.

* * * * *